United States Patent [19]

Frank

[11] 3,939,997

[45] Feb. 24, 1976

[54] TRACTOR MOUNTED IMPLEMENT DEVICE

[75] Inventor: Eldon M. Frank, Lake View, Iowa

[73] Assignee: F & W Company Inc., Lake View, Iowa

[22] Filed: Feb. 3, 1975

[21] Appl. No.: 546,433

Related U.S. Application Data

[63] Continuation-in-part of Ser. No. 260,465, June 7, 1972, Pat. No. 3,863,786.

[52] U.S. Cl. ..... 214/131 A; 172/275

[51] Int. Cl.[2] ..... E02F 3/72

[58] Field of Search ..... 214/131 A, 145, 152; 172/272, 275

[56] References Cited

UNITED STATES PATENTS

| | | | |
|---|---|---|---|
| 3,043,375 | 7/1962 | Åström | 214/131 A |
| 3,324,954 | 6/1967 | Westendorf | 214/131 A |
| 3,610,450 | 10/1971 | Demkiw | 214/131 A |

FOREIGN PATENTS OR APPLICATIONS

| | | | |
|---|---|---|---|
| 1,924,269 | 11/1970 | Germany | 214/131 A |
| 833,368 | 2/1970 | Canada | 214/131 A |
| 1,248,551 | 8/1967 | Germany | 214/131 A |

OTHER PUBLICATIONS

"Triggs Farming Tools Catalogue" pp. 7–9, printed Nov. 1, 1967.

*Primary Examiner*—Robert J. Spar
*Assistant Examiner*—Ross Weaver
*Attorney, Agent, or Firm*—Zarley, McKee, Thomte & Voorhees

[57] ABSTRACT

A tractor includes a downwardly and forwardly opening guide support channel extending across the front end for engagement with the transversely extending portion of a U-shaped frame of an implement which also includes upstanding standards having a boom pivotally connected thereto with a ground-working tool on the outer end. A support stand is connected to the forward end of the U-shaped frame and rearwardly extending feet are provided on the standard for engaging slots on oppositely disposed support brackets carried on the tractor. Hydraulic power cylinders extend between the U-shaped frame and the boom. Upon the tractor being driven forwardly into the U-shaped frame and the transversely extending member being positioned in the open end of the channel the power cylinders are operated to pivot the U-shaped frame toward the boom about an axis through the channel until the standards engage the oppositely disposed support brackets whereupon pivoting then occurs about an axis through the support brackets and the forward end of the implement is pivoted upwardly causing the transversely extending member to move upwardly and rearwardly in the channel thereby moving the implement rearwardly on the tractor without the tractor being moved forwardly and wedge-shaped feet on the standards move into complementarily shaped openings on the support brackets to limit vertical movement of the standards. A vertically disposed pin locks the feet to the brackets limiting horizontal movement of the implement relative to the tractor.

11 Claims, 6 Drawing Figures

TRACTOR MOUNTED IMPLEMENT DEVICE

BACKGROUND OF THE INVENTION

This application is a continuation-in-part application of my Implement Device and Method of Mounting Same on Tractor application, Ser. No. 260,465, filed June 7, 1972 now U.S. Pat. No. 3,863,786.

The prior disclosure utilizes the power cylinder for pivoting the implement onto and off of the tractor but does not involve any movement of the implement horizontally relative to the tractor during the mounting operation. The method of this disclosure contemplates the power cylinder not only pivoting the implement onto and off of the tractor but also moving the implement rearwardly relative to the stationary tractor as a result of the cross member of the U-shaped implement frame being forced to move in an angularly disposed channel opening downwardly and forwardly whereby as the implement frame is pivoted upwardly it is forced rearwardly as the transverse member moves from the open end to the closed end of the channel. The rearward movement of the implement on the tractor allows for feet on the upright standards to move into locking engagement with cross portions on the support brackets oppositely disposed on the tractor thereby limiting the standards against vertical movement. This particular mounting structure and procedure is particularly suited for utility type tractors which may not include side frame members on which forward mounting brackets may be positioned.

SUMMARY OF THE INVENTION

In accordance with the present invention the implement is supported independently of the tractor by a ground-working tool on the forward end of the boom and a support stand on the forward end of the U-shaped frame and the lift cylinders for the boom maintain the frame stationary relative to the boom until the mounting procedure begins. The tractor is driven forwardly into the U-shaped frame until the transversely extending member of the U-shaped frame is positioned in the open end of the downwardly and forwardly opening guide support channel on the forward end of the tractor. Now the power cylinders are connected and operated to contract them thereby causing the U-shaped frame to pivot about an axis through the channel until the lower ends of the standards engage the oppositely disposed support brackets on the tractor whereupon the forward end of the U-shaped frame now begins to pivot upwardly about an axis through the oppositely disposed support brackets and the channel extending upwardly and rearwardly causes the transversely extending frame member to move upwardly and rearwardly thereby moving the implement rearwardly on the tractor and wedge-shaped rearwardly extending feet on the standards move into complementarily-shaped openings on the support brackets thereby automatically locking the standards against vertical movement and a vertical pin may now be dropped through the feet to limit the standards against horizontal movement. Further rearward movement of the U-shaped frame on the tractor is limited by the transversely extending member engaging the base of the guide support channel. The stand is now lifted off of the ground and may be pivoted to an upright position.

DESCRIPTION OF THE DRAWINGS

In the drawings which illustrate an embodiment of the invention.

DESCRIPTION OF THE PREFERRED EMBODIMENT

Figure 1:
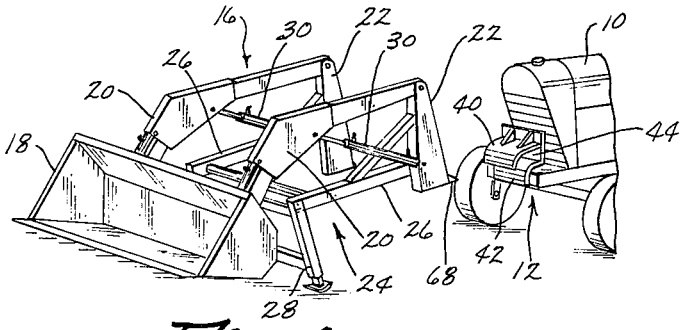
FIG. 1 is a perspective view of the loader implement of this invention shown detached from the tractor.

The combination implement and tractor of this invention includes tractor 10 having a front-mounting bracket 12 and oppositely disposed side mounting brackets 14. The implement 16 includes a ground-working tool shown as a bucket 18 on the forward ends of boom members 20 pivotally mounted to the upper ends of upstanding standards 22. A U-shaped frame 24 includes side frame members 26 connected to the standards 22 and having a transversely extending frame member 28 at the forward end for engagement in the bracket 12 on the tractor 10.

The implement independent of the tractor is supported by the scoop 18 cooperating with a stand 28 pivotally connected to the side frame members 26 of the U-shaped frame 24. Hydraulic power cylinders 30 extend between the base of the standards 22 and the outer ends of the boom members 20 and allow for pivotal movement between the boom and the U-shaped frame 24. The guide support channel bracket 12 on the forward end of the tractor opens downwardly and forwardly and includes an upper curved wall 40 and a lower curved wall 42 defining an opening 44. It is seen that the longitudinal axis of the channel is angularly disposed to the vertical and horizontal axes. A base wall 50 is provided.

Figure 5:
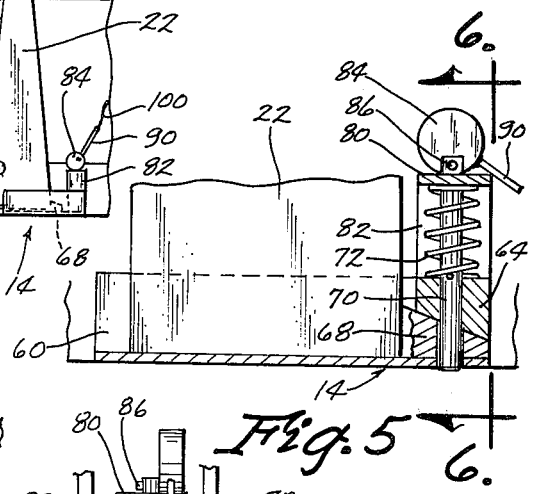
FIG. 5 is an enlarged fragmentary side elevation view of the standards connected to the side mounting bracket.

The side support brackets 14 each include side walls 60, a base wall 62 and a cross member 64 spaced above the bottom wall 62 to define a locking opening 66 wedged shaped to complement a wedge-shaped foot 68 extending rearwardly from the base of the standards 22. A pin 70 is extendable through the cross member 64 and the foot 66 and is biased into the locking position of FIG. 5 by a coil spring 72 engaging the cross portion 64 and a stationary plate 80 on legs 82 connected to the cross portion 64. An eccentrically pivoted cam member 84 is pivotally connected at 86 to the pin 70 and engages the top surface of the plate 80 for lifting the pin 70 out of engagement with the foot 68 as desired. A lever 90 is provided for pivoting the cam 84 for operating the pin 70.

Figure 2:
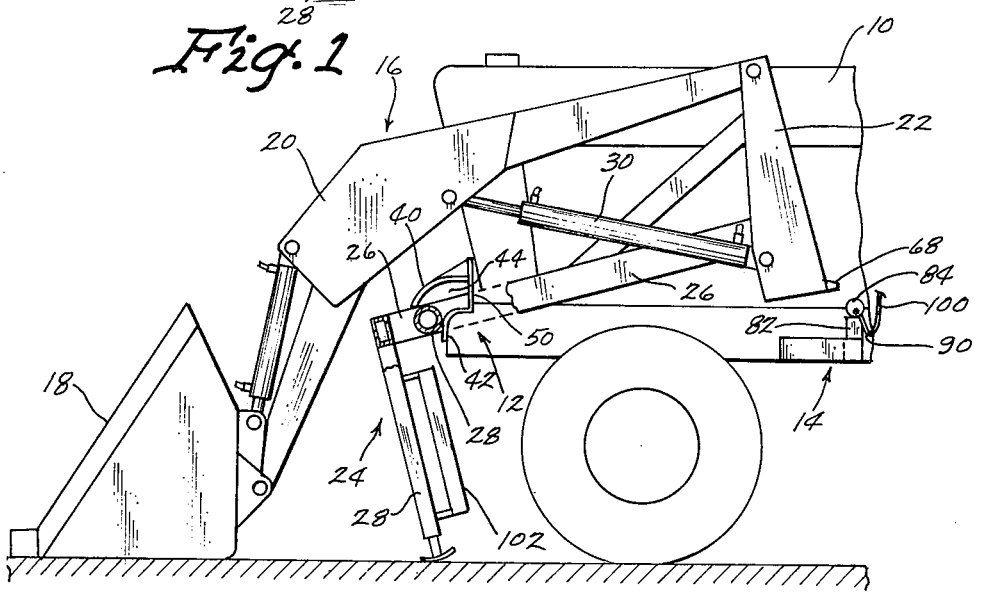
FIG. 2 is a side elevation view of the tractor after having been driven into the implement frame prior to operation of the power cylinders.
Figure 3:
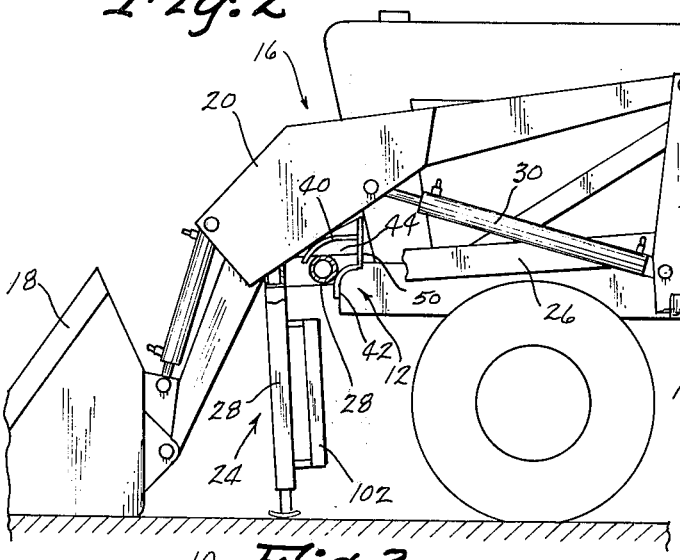
FIG. 3 is a view similar to FIG. 2 showing the implement after the initial pivoting about an axis through the guide support channel.
Figure 4:
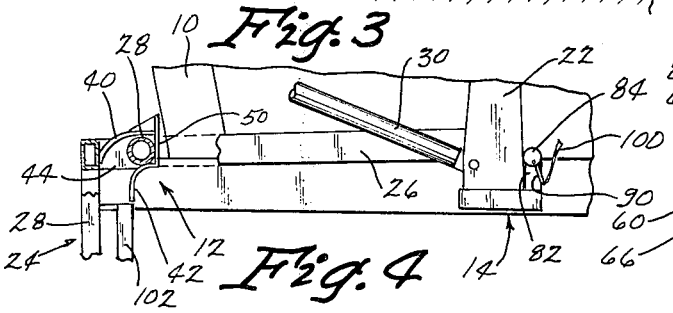
FIG. 4 is a fragmentary view similar to FIG. 3 illustrating the implement in its mounted position after further pivoting has occurred about an axis through the rear support brackets which has caused the implement to move rearwardly on the tractor.
Figure 6:
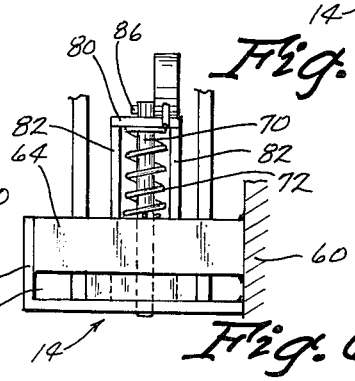
FIG. 6 is a cross-sectional view taken along line 6—6 in FIG. 5.

Thus it is seen in operation that the implement 16 is mounted on the tractor 10 by first driving the tractor into the U-shaped frame 24 to the position of FIG. 2 where the cross member 28 is positioned in the open end of the channel bracket 12 against the lower wall 42. The power cylinders 30 may now be connected to the hydraulic system of the tractor and the cylinders are then contracted causing the frame 24 to pivot towards the boom 20 to the position of FIG. 3 whereby the rear end of the implement and specifically the standards 22 move downwardly into engagement with the brackets 14. Next the contraction of the power cylinders 30 is continued and now the pivoting occurs about a pivotal axis through the support brackets 14 this time causing the forward end of the U-shaped frame member to pivot upwardly and this moves the transverse member 28 further along in the channel bracket 12 such that the U-shaped frame moves rearwardly to the position of FIG. 4 where the transversely extending member 28 now engages the base wall 50 of the channel bracket 12 and the forward end of the implement is limited against further horizontal movement to the rear as well as vertical movement either up or down. Simultaneously the wedge-shaped feet 68 have moved rearwardly along the bottom wall 62 of the support bracket into the opening 66 formed by the cross portion 64 and the bottom wall 62. It is seen that the opening is also wedged shape to complement the cross section of the foot and thereby the standard is integrally locked to the support bracket 14. The foot 68 is now in alignment with an opening in the cross portion 64 such that the pin 70 is locking the foot against horizontal movement. The pin is lowered by rotating the eccentrically mounted cam 84 through operation of the lever 90 which may be connected to a trip rope 100.

The stand 28 may now be pivoted to an upstanding out-of-the-way position and will now function as a guard for the radiator of the tractor and may also be used to carry weights in the bracket 102 if desired.

The removal of the implement from the tractor is accomplished by reversing the procedure basically described by removing the pin 70 and expanding the power cylinders after the stand has been pivoted to the down position and this will cause the implement to move forwardly relative to the tractor which remains stationary during all mounting and demounting operations. Consequently, the cross member 28 now moves to the open end of the guide support channel 12 whereby the tractor 10 may be backed out of the implement after the hydraulic hoses have been disconnected. The implement is now free to stand independently on the ground-working tool 18 and the stand 28.

What is claimed is:

1. The method of mounting an implement on a tractor wherein the implement includes a ground-engaging tool carried on a boom pivotally connected to upright standards on a U-shaped frame having a support stand for supporting said implement in cooperation with said tool independent of said tractor and power means for pivoting the boom relative to said U-shaped frame, and said tractor including a guide support channel opening forwardly and downwardly and rearwardly positioned support brackets on opposite sides thereof, said method comprising the steps of, driving the tractor forwardly until a transversely extending portion on the U-shaped frame is positioned in the open end of the guide support channel, operating the power means to pivot said boom and said U-shaped frame towards each other about an axis through said channel and until the upright standards engage said support brackets, and operating the power means further to pivot said boom and U-shaped frame towards each other about an axis through said support brackets thereby moving the transversely extending portion upwardly and rearwardly in said channel and causing said implement to move rearwardly on said tractor without moving tractor.

2. The method of claim 1 wherein moving of said implement rearwardly on said tractor causes said standards to move into locking engagement with said support brackets.

3. In combination, an implement mountable on a tractor, comprising, an implement having a boom with a ground engaging tool on the outer end and pivotably mounted to upright standards at its inner end carried on a U-shaped frame and power means extendably interconnects said U-shaped frame and boom for relative pivotal movement therebetween, said U-shaped frame having a transversely extending member and a stand connected thereto for cooperation with said tool for supporting said implement independently of said tractor, a tractor having oppositely disposed rear side support brackets for engagement with said standards, and a downwardly and forwardly opening guide support channel on said tractor for receiving said transversely extending member whereby upon said transversely extending member being positioned in open end of said channel and said power means being operated to pivot said U-shaped frame and said boom towards each other said U-shaped frame pivots about an axis through said channel until said standards engage said support brackets whereupon continued operation of said power means causes said U-shaped frame to pivot about an axis through said support brackets and thereby moving said transversely extending member upwardly and rearwardly in said channel without said tractor having been moved forwardly.

4. The structure of claim 3 wherein said power means is further defined as being hydraulic cylinders extending between said U-shaped frame and said boom.

5. The structure of claim 3 wherein said downwardly and forwardly opening guide support channel is positioned across the front end of said tractor and said transversely extending member on said U-shaped frame extends between the oppositely disposed legs of said U-shaped frame.

6. The structure of claim 3 wherein said standards and support brackets on said tractor include cooperating lock means engageable upon said implement being moved rearwardly on said tractor.

7. The structure of claim 6 wherein said lock means on said standards include rearwardly extending feet portions and said lock means on said support brackets include cross members spaced above said brackets and defining an opening for receiving said feet and thereby limit relative vertical movement of said standards.

8. The structure of claim 7 wherein a pin element is positioned to extend through said cross member on one of said brackets and engage the foot in said opening thereby limiting horizontal movement of said standard.

9. The structure of claim 8 wherein said pin is spring loaded to normally extend through said foot.

10. The structure of claim 9 wherein said pin includes an eccentrically mounted cam means connected thereto and in engagement with a stationary means whereby rotation of said cam causes said pin to be lifted against the action of said spring.

11. The structure of claim 7 wherein said feet and openings are complementingly wedged shaped.

* * * * *